US006310440B1

(12) United States Patent
Lansing et al.

(10) Patent No.: US 6,310,440 B1
(45) Date of Patent: Oct. 30, 2001

(54) SYSTEM FOR INDIVIDUAL AND REMOTE CONTROL OF SPACED LIGHTING FIXTURES

(75) Inventors: Adam T. Lansing; Russell L. MacAdam, both of Allentown; Noel Mayo, Philadelphia; Scott C. Miller, Lehighton; Robert A. Reiss, Easton; Ian Rowbottom, Chalfont; Joel S. Spira, Coopersburg, all of PA (US)

(73) Assignee: Lutron Electronics Company, Inc., Coopersburg, PA (US)

( * ) Notice: Subject to any disclaimer, the term of this patent is extended or adjusted under 35 U.S.C. 154(b) by 0 days.

(21) Appl. No.: 09/479,744

(22) Filed: Jan. 7, 2000

Related U.S. Application Data

(62) Division of application No. 08/585,111, filed on Jan. 11, 1996, now Pat. No. 6,037,721.

(51) Int. Cl.[7] ..... G05F 1/00

(52) U.S. Cl. ..... 315/149; 315/157; 315/158; 455/899

(58) Field of Search ..... 455/130, 899; 315/149, 150, 156, 157, 158

(56) References Cited

U.S. PATENT DOCUMENTS

| | | |
|---|---|---|
| Re. 29,172 | 4/1977 | Lutz . |
| 2,675,505 | 4/1954 | Flurscheim et al. . |
| 2,748,226 | 5/1956 | MacNeill et al. . |
| 3,223,888 | 12/1965 | Koppelmann . |
| 3,249,810 | 5/1966 | Strom et al. . |
| 3,284,648 | 11/1966 | Kopplemann . |
| 3,321,668 | 5/1967 | Baker . |
| 3,395,316 | 7/1968 | Denes et al. . |
| 3,402,324 | 9/1968 | Kesseling et al. . |
| 3,491,315 | 1/1970 | Kesseling et al. . |
| 3,558,910 | 1/1971 | Dale . |
| 3,636,292 | 1/1972 | Roth . |
| 3,639,808 | 2/1972 | Ritzow . |
| 3,864,604 | 2/1975 | Pfanzelt . |
| 3,868,549 | 2/1975 | Schaefer et al. . |
| 3,982,137 | 9/1976 | Penrod . |
| 4,074,333 | 2/1978 | Murakami et al. . |

(List continued on next page.)

FOREIGN PATENT DOCUMENTS

| | | |
|---|---|---|
| 4124794 | 1/1993 | (DE) . |
| 0062004 | 10/1982 | (EP) . |
| 0482680 | 4/1992 | (EP) . |

*Primary Examiner*—David Vu
(74) *Attorney, Agent, or Firm*—Ostrolenk, Faber, Gerb & Soffen, LLP

(57) ABSTRACT

A plurality of spaced ceiling mounted fixtures or other controllable electrical appliances have radiation detectors mounted within each fixture and wired internally of the fixture to a dimming circuit or to a ballast. The radiation detectors have sensitivity over a wide angle and have elongated plastic radiation conduction rods which extend to or beyond the plane of the lens of the fixture to be located free of shadow effects of reflections of the fixture lens. A flexible end light fiber optics can be used in place of the acrylic rods. A narrow beam radiation transmitter selectively illuminates one of the rods or end light fiber optics without illuminating the others. The dimming circuits or ballasts within the fixtures can be further controlled by external dimmers, occupancy sensors, timeclocks, photosensors and other types of input devices. The radiation detector and ballast can occupy a common housing and share the same power supply and circuit board. The microcontroller for the radiation detector operates with a 4 of 4 voting mode until a valid signal is detected to switch the system to a 3 of 4 voting mode. A novel mounting adaptor for mounting a visible light fiber optic cable is disclosed with the visible light fiber optic cable conducting infrared radiation for up to 24 inches.

20 Claims, 12 Drawing Sheets

U.S. PATENT DOCUMENTS

| | | |
|---|---|---|
| 4,152,634 | 5/1979 | Penrod . |
| 4,209,814 | 6/1980 | Garzon . |
| 4,236,101 | 11/1980 | Luchaco . |
| 4,251,845 | 2/1981 | Hancock . |
| 4,346,419 | 8/1982 | Janniello . |
| 4,349,748 | 9/1982 | Goldstein et al. . |
| 4,389,691 | 6/1983 | Hancock . |
| 4,392,171 | 7/1983 | Kornrumpf . |
| 4,709,188 | 11/1987 | Roberts . |
| 4,727,296 | 2/1988 | Zaharchuk et al. . |
| 4,772,809 | 9/1988 | Koga et al. . |
| 4,855,612 | 8/1989 | Koga et al. . |
| 4,889,999 | 12/1989 | Rowen . |
| 5,107,184 | 4/1992 | Hu et al. . |
| 5,191,265 | 3/1993 | D'Aleo et al. . |
| 5,283,706 | 2/1994 | Lillemo et al. . |
| 5,404,080 | 4/1995 | Quazi . |
| 5,451,843 | 9/1995 | Kahn et al. . |
| 5,565,739 | 10/1996 | Brownell . |
| 5,597,233 | 1/1997 | Lau . |
| 5,633,540 | 5/1997 | Moan . |
| 5,637,964 | 6/1997 | Hakkarainen . |
| 5,661,468 | 8/1997 | Marcoux . |
| 5,987,205 | 11/1999 | Moseley . |

FIG. 7.
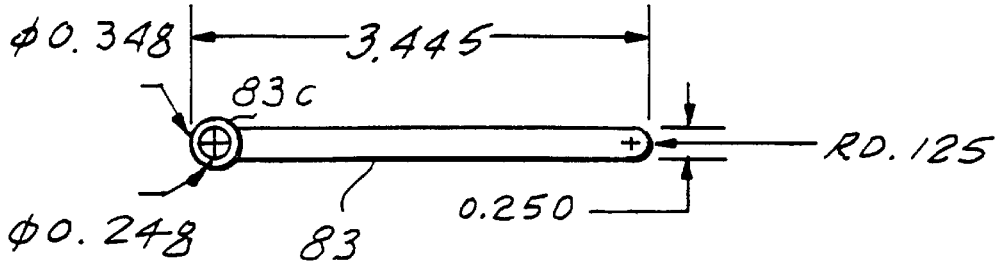
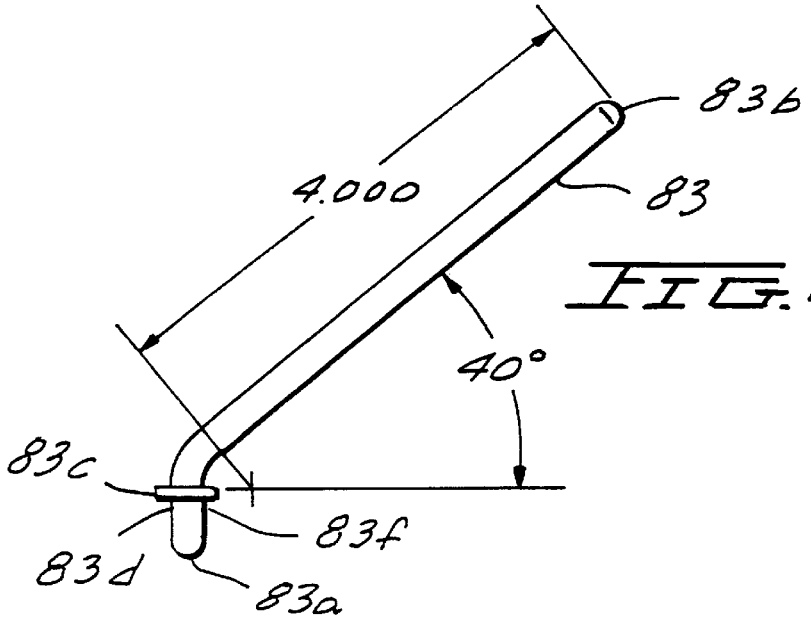
FIG. 6.
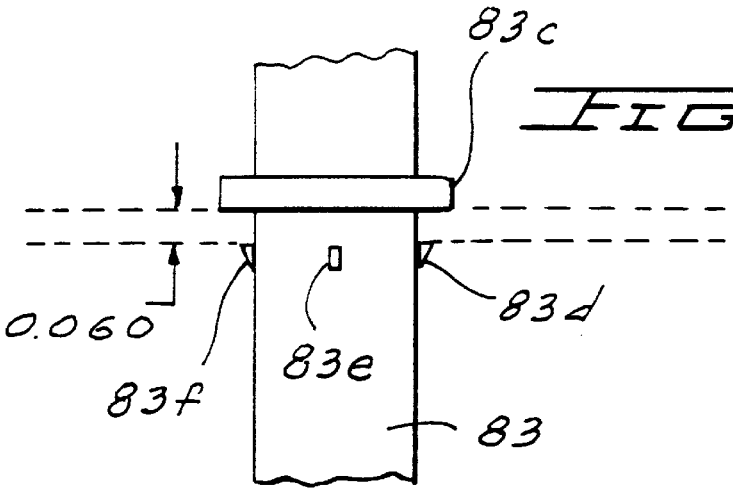
FIG. 8.

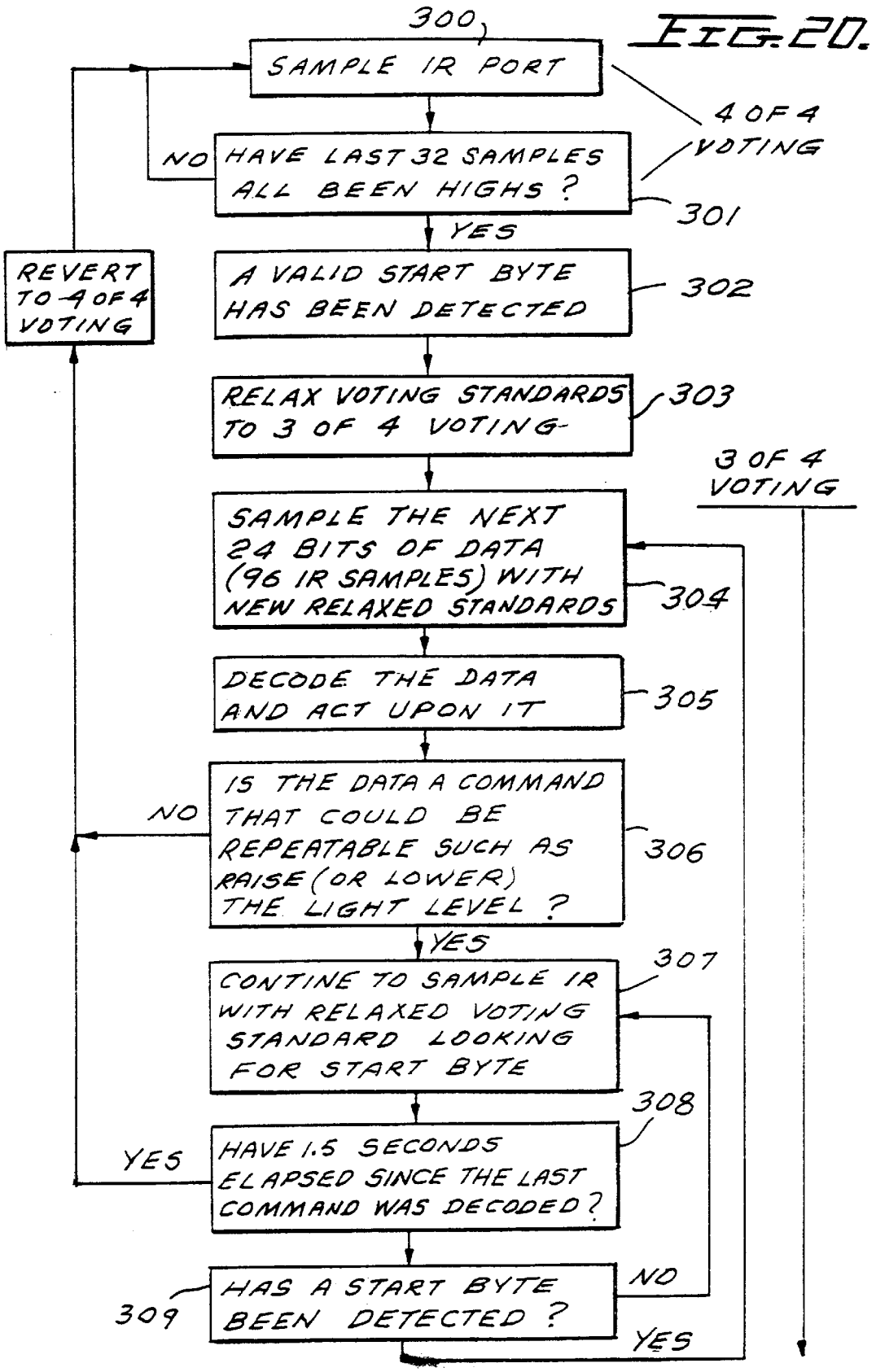
FIG. 20.
300
SAMPLE IR PORT
4 OF 4 VOTING
NO
HAVE LAST 32 SAMPLES ALL BEEN HIGHS ?
301
YES
REVERT TO 4 OF 4 VOTING
A VALID START BYTE HAS BEEN DETECTED
302
RELAX VOTING STANDARDS TO 3 OF 4 VOTING
303
3 OF 4 VOTING
SAMPLE THE NEXT 24 BITS OF DATA (96 IR SAMPLES) WITH NEW RELAXED STANDARDS
304
DECODE THE DATA AND ACT UPON IT
305
NO
IS THE DATA A COMMAND THAT COULD BE REPEATABLE SUCH AS RAISE (OR LOWER) THE LIGHT LEVEL ?
306
YES
CONTINE TO SAMPLE IR WITH RELAXED VOTING STANDARD LOOKING FOR START BYTE
307
308
YES
HAVE 1.5 SECONDS ELAPSED SINCE THE LAST COMMAND WAS DECODED ?
NO
309
HAS A START BYTE BEEN DETECTED ?
YES

SYSTEM FOR INDIVIDUAL AND REMOTE CONTROL OF SPACED LIGHTING FIXTURES

RELATED APPLICATIONS

This application is a division of application Ser. No. 08/585,111, filed on Jan. 11, 1996 now U.S. Pat. No. 6,037,721.

This invention is related to and is an improvement of the subject matter of application Ser. No. 08/407,696, filed Mar. 21, 1995, in the names of Simo P. Hakkarainen et al, and entitled REMOTE CONTROL SYSTEM FOR INDIVIDUAL CONTROL OF SPACED LIGHTING FIXTURES (P/10-382).

FIELD OF THE INVENTION

This invention relates to the remote control of lighting fixtures, and more specifically relates to an improved system and components therefor for the selective control of overhead lighting fixtures by a hand-held infrared radiation source, and is an improvement of the system and components described in the above-identified application Ser. No. 08/407,696, the subject matter of which is incorporated herein by reference.

BACKGROUND OF THE INVENTION

Prior known systems for remote control of lighting fixtures are described in detail in the above-noted copending application Ser. No. 08/407,696.

Thus, the lighting of spaces by a plurality of spaced gas discharge lamps (for example, fluorescent lamps), or incandescent lamps is well known. Commonly, one or more fluorescent lamps are mounted in a fixture with a ballast, and such fixtures are spaced over a ceiling on four foot or eight foot centers. Similarly, overhead fixtures for incandescent lamps may be mounted on centers greater than about two feet. Such lamp fixtures are commonly connected to a single power source and are simultaneously turned on and off or, if provided with dimming capability, are simultaneously dimmed.

It is also known that such overhead fixtures can be individually controlled or dimmed. For example, in a given office space, one worker may prefer or need more or less light intensity than another worker at a spaced work area. Dimming systems are known for selectively dimming the lamps of different fixtures to suit the needs of individual workers. For example, each fixture can be individually hard wired to its own remotely mounted dimmer. However, the installation of this wiring can be quite costly and the determination of which dimmer controls which fixture may not be immediately obvious to the user of the system.

Alternatively the dimmers could be located within each fixture and controlled by signals sent over low voltage wiring or through signals transmitted over the line voltage wiring through a power line carrier system. Unfortunately, both of these approaches require expensive interfaces within each fixture to translate and/or decode the received signals for control of the dimmer.

In another known system, a dimmer with a dimming adjustment control is provided at each fixture, and that control is manually operated, for example by rotating the control with a rigid pole long enough to reach the fixture. In this way, each fixture can be selectively adjusted. However, the system is inconvenient to use and, once the fixture intensity is set, it is difficult or inconvenient to readjust.

Moreover, it is difficult to retrofit an existing installation with a control system of this nature.

A known fluorescent controller system is also sold by Colortran Inc. of Burbank, Calif., termed a "sector fluorescent controller" in which an infrared receiver is mounted at a location spaced from its respective fluorescent lamp fixture. Thus, the receiver is fixed to a T-bar, on the wall, on a louver or is counter-sunk flush with wall or ceiling. A ballast controller may be mounted in the lighting fixture, in addition to a conventional dimming ballast. Wiring is then run from the external infrared receiver into the interior of the fixture to the ballast controller. A hand-held remote control infrared transmitter illuminates the infrared receiver at one or more fixtures to control their dimming level.

The need to run wiring from the external sensor complicates the installation of such devices. Further, since the sensor is spaced from the fixture, it requires separate installation, and is visible to view. Moreover, the infrared transmitter of the Colortran device has a transmitting angle of 30°. Therefore, several receivers can be illuminated simultaneously, making selection of control of only one fixture difficult unless the user places himself in a precise location within the room under the fixture to be controlled.

A similar system is sold by the Silvertown Hitech Corporation, where the infrared receiver is mounted to the louvers of a fluorescent fixture. In this system, the infrared receiver is specifically adapted to be mounted to a specific fluorescent fixture, and it tends to block light output from the fixture.

A further system is sold by Matsushita wherein a single transmitter can be used for independent control of two or more different receivers. This is achieved by adjusting a switch on the transmitter to correspond to a switch setting which has been previously set at the receiver corresponding to the fixture desired to be controlled. For example, fixture A could be controlled when the switch is in position 1 and fixture B could be controlled when the switch is in position 2. In this system, the user must remember which fixture corresponds to which switch position, i.e., A corresponds to 1 and B corresponds to 2.

It is easy for the user to forget and become confused, particularly when there are three or four fixtures controlled by three or four switch positions. This is an undesirable situation. Further, there is a practical limitation on the number of switch positions which can be provided and the number of fixtures in a large room will exceed this. Additionally, there is a great deal of work in programming and reprogramming the receivers for a large number, for example, 20 fixtures.

In comparison with the system of the invention of copending application Ser. No. 08/407,696, as will be described in more detail later, the transmitter is simply pointed at the receiver in the fixture which it is desired to control. This is simple, unambiguous and transparently ergonomic. Further, it does not require any preprogramming or reprogramming of the receivers.

It is also known to use an infrared transmitter for the control of a wall box mounted dimmer, such as the "Grafik Eye" Preset Dimming Control sold by Lutron Electronics Co., Inc., the assignee of the present invention. Also see U.S. Pat. No. 5,191,265 which describes such transmitters. The Grafik Eye Dimmer Control system provides for the remote control of fixtures and other lamps by a control circuit located at the wall box which controls those fixtures and lamps. An infrared transmitter aimed at the wall box housing produces a beam which contains information to turn on and off and to set the light dimming level of the fixtures being controlled to one of a plurality of preset levels, or to continuously increase or decrease the light level. Other similar systems are sold by Lutron Electronics Co., Inc. under the trademark RanaX-Wireless Dimming Control System. Such systems are not intended to control individual ceiling fixtures in a room independently of other closely spaced fixtures (those fixtures spaced up to about two feet apart).

The invention of copending application Ser. No. 08/407,696 solved the problems referred to above. Thus, in accordance with that invention, each fixture to be controlled has a radiation receiver and ballast control circuit mounted in the interior of the fixture housing and is wired internally of the fixture housing to a dimming ballast in the case of a fluorescent fixture. In the case of an incandescent fixture, each light to be controlled has a radiation receiver and dimmer, which is connected to the lamp to be controlled. A small opening in the fixture housing allows optical communication with the radiation receiver and is easily illuminated from substantially any location in the room containing the fixtures. A narrow beam radiation transmitter with a beam angle, for example, of about 8° is employed to illuminate the radiation-receiving opening in the fixture without illuminating the fixtures spaced greater than about two feet from the fixture to be controlled. For rooms about thirty feet by thirty feet in area and ten feet high, fixtures two feet apart can be easily discriminated between one another. For larger spaces, the user can reposition himself to discriminate between closely spaced fixtures.

The receiver is a novel structure containing a printed circuit board mounted across a central area of a typical back box. A radiation sensor is mounted on the printed circuit board and faces an open side of the box which is covered by a yoke. The radiation employed is preferably infrared light and the yoke has an infrared transparent portion to allow infrared radiation to reach the radiation sensor. Narrowly focused, high frequency ultrasound could also be employed.

In addition, either a visible or invisible laser beam with information encoded on it in known manner could be used, with the laser beam being spread by optical means such as a divergent lens. In the case of a visible beam, this would produce a beam like a flashlight pointer which would aid in pointing the transmitter at the receiver.

Finally, narrowly focused radio frequency waves could be used. These could be emitted from a parabolic reflector on the transmitter, using a parabolic reflector of approximately 4.3 cm in diameter and a frequency of 60 GHz. The beam spread would be approximately 8°. The opening used for optical signals would, of course, be modified if radio frequency waves are used.

To install the receiver structure of application Ser. No. 08/407,696, a novel mounting structure is provided whereby a plastic hook and loop type fastener surface is fixed to the yoke and a cooperating hook and loop type surface is attached to the interior of the fixture, preferably on the wire way cover within the fixture. All wires can then be interconnected within the fixture wire-way. An opening is formed in the wire-way cover of the fixture and optically communicates with the radiation receiver within the receiver housing. The receiver housing is easily located within the wire-way housing to communicate with the opening in the wire-way cover and is then pressed in place. An optical lens insert can be installed in the yoke to assist in focusing input radiation on the radiation receiver sensing element. This lens insert can be interchangeable and different lens inserts can be designed to have different angles of acceptance of input radiation.

The lens protrudes slightly through an opening in the fixture housing to receive infrared radiation from the transmitter. The transmitter is an infrared transmitter of the type employed in the Lutron Grafik Eye system previously identified for use with wall box dimmer systems. The Grafik Eye transmitter is an infrared transmitter which transmits signals with twelve different code combinations. The transmitter is operable to transmit a beam angle of about 8° and can, therefore, selectively illuminate relatively closely spaced ceiling fixtures. Depending on the control which is activated, a selected fixture can be dimmed to one of a plurality of preset dim conditions, or can be dimmed continuously up or down. Thus, the transmitter can accomplish raise/lower, presets, low/high end trim and the like. Alternatively, a transmitter with a movable slide or rotary actuator could be used to provide continuous dimming control.

This novel structure had a major advantage in retrofitting an existing installation. Thus, it is only necessary to drill a small opening in the wire-way cover, and mount an infrared receiver/ballast controller to the wire-way cover in line with the opening within the wire-way cover. Light dimming ballasts are then mounted within the fixture wire-way and are interconnected with the receiver/ballast controller within the fixture wire-way without need for external wiring. The wire-way cover with receiver/ballast controller attached is then reinstalled in the fixture.

The previously described invention of application Ser. No. 08/407,696 is also disclosed for use with a large variety of existing fixtures and can also be used with external switches and dimming circuits. Photocells, occupancy sensors, time clocks, central relay panels and other inputs can also be used with the novel system. Furthermore, that invention made it possible for a single receiver to operate any desired number of ballasts.

The primary application of the invention of application Ser. No. 08/407,696 is in large open plan office areas illuminated by overhead fluorescent fixtures, particularly where video display units (e.g., personal computers) are used. However, the invention also has applications in areas which are used for audio visual presentations, in hospitals and elder care facilities, in manufacturing areas and in control rooms, the control of security lighting either indoor or outdoor and to reduce lighting levels for energy conservation.

A further application of the prior invention is in wet or damp locations where normal wall controls cannot be used due to the danger of electric shock or in areas with hazardous atmospheres where there is a danger of explosion if a line voltage wall control is operated and causes a spark. In these cases, the receiver can be located in a protected fixture and the lights controlled by the low voltage hand-held remote control transmitter.

The prior invention was described with respect to the control of light levels. However, the output from the receiver could be adapted in known manner to control motor speed and/or position such as the position of the motors in window shade control systems. The output from the receiver could further be adapted to control other types of actuators such as solenoids.

The above-described invention of application Ser. No. 08/407,696 performs very well. However, it has been found that the system was directionally sensitive due to shadowing and unpredictable reflections of the radiation by the light fixture baffle or lens. It was also found that the system was sensitive to sources of infrared radiation other than the infrared signal of the remote transmitter, and further, that the system was slow in responding to a valid infrared signal from the transmitter because the receiver was waiting for a signal while in an "insensitive" state.

A further problem with the system of application Ser. No. 08/407,696 was that an expensive fiber optic cable was required when the end of the IR receiver was removed some distance, for example, up to 24 inches from the IR receiver housing.

BRIEF SUMMARY OF THE INVENTION

In accordance with a first feature of the present invention, the radiation receiver extending from the radiation receiver housing is an elongated radiation conductor or antenna which has a length which is sufficiently long that it extends from the fixture wire way to which receiver is attached to a free end which is flush with or penetrates beyond the plane of the fixture reflector surface or lens cover. Thus, typical fixtures employ parabolic or prismatic lens covers or baffle structures which tend to shadow or block line-of-sight radiation from a location at an angle to a vertical from the fixture. By elongating the radiation receiver, its free end or tip is in or slightly beyond the outermost plane of the fixture baffle structure so that the radiation received by the end of the radiation receiver is unaffected by shadowing or internal reflection within the lens cover.

In one embodiment, the radiation receiver is a thin, rigid, molded plastic (such as an acrylic or polycarbonate) radiation conductive rod of non-critical diameter, for example, of ¼ inch and a length, which is non-critical, but typically may be about 5 inches, depending on the structure of the fixture lens. The outer or free end of the receiver rod can be cut either round, or square at its end, while the inner end of the rod facing a sensor in the receiver housing may preferably have a convex radius. The rod may be formed with any desired axial elongation, for example, as a straight rod which extends perpendicularly from the yoke of the receiver housing, or with a bend or curve to meet the needs of mounting the radiation receiver within a fixture. Whatever shape is used, it is critical that the free end of the radiation receiver is sufficiently long that it is not shadowed by the fixture baffle or lens.

The receiver rod, which may be any desired infrared (IR) transmitting plastic rod may be co-molded with numerous differently shaped rods in a common mold which are shipped with the light receiver housing and/or system equipment so that the user can select the rod shape best adapted to his fixture.

In an alternative embodiment and as a further enhancement, a portion of the receiver may be covered with an infrared shielding material or structure which blocks lamp infrared and thus improves signal to noise ratio, thus giving greater reception range. The shield structure may be a parabolic curve to not only shield infrared noise, but also focus infrared signals onto the receiver rod.

Preferably, the radiation receiver rod or guide can be connected to the receiver housing by a snap-fit which permits the rod to rotate about its axis at its connection to the receiver. Thus, the end connected to the receiver housing is always fixed relative to the LED or other radiation sensor within the housing, while still permitting rotation of the rod to enable the adjustment of the position of the free end of the rod at the outer plane of the fixture lens. Note that other connections can be used, such as compression fittings, a screw type connection, a lock and key arrangement or a simple bayonet-type connection.

The receiver housing of the present invention must often be mounted remote from the location at which a transmitter signal can be received. In such a case, an elongated, flexible radiation conductor or light pipe of up to 2 feet in length is employed, with one end fixed to the receiver housing, and the free end secured, for example, in the ceiling tile adjacent the fixture. In prior devices employing infrared radiation as the carrier, a conventional but expensive fiber optical cable light pipe has been used, with one end located adjacent the IR sensor in the receiver housing and the other "free end" fixed to a connector to connect the free end through a ceiling tile or the like to be exposed to the interior of the room containing the lighting fixture. End ferrule terminals are needed at the ends of such a light pipe. It is desirable to employ a less expensive infrared conductor in place of the flexible light fiber conductor.

Visible light conductors are available which are flexible thin cables with a bend radius as small as 1 inch. These are termed "end light fiber optics" and consist of an elongated light transmitting silicon monomer gel core which has a Teflon® cladding layer and an outer black plastic jacket. Such devices are used for visible light conduction for spot, flood light and underwater applications. The Teflon® cladding acts as a light shield and the black jacket is for U.V. protection and prevents yellowing of the gel core. One such cable is part number EL 100 made by Lumenyte International Corporation of Costa Mesa, Calif. having a length of about 24 inches and a diameter of about 3/16 inch. Such conductors are less expensive than conventional infrared fiber optic conductors.

It has been believed that the light transmitting core of end light fiber optics severely attenuates infrared radiation, for example, radiation with a wave length of about 880 nanometers. However, it has been found, unexpectedly, and contrary to common belief, that an end light fiber optics cable with a visible light conducting gel core does not attenuate infrared (at about 880 nanometers) sufficiently to interfere with its use as an elongated (up to about 24 inch) infrared conductor for the present invention. Thus, the invention can employ an inexpensive elongated end light fiber optics conductor in place of an expensive elongated infrared fiber optics conductor.

Note that the fixed end of the end light fiber optics can be adapted to snap into or be fixed to the radiation receiver housing in the same manner as the shorter rigid plastic rod previously described. Thus, no change is required in the structure of the housing which can universally receive radiation conductors of various types. Where end light fiber optics cable is used, it is not necessary to make the cable rotatable relative to the housing in view of the inherent flexibility of the cable.

A special connector is provided to fix the free end of the fiber optics cable to and through a ceiling tile. In general the connector contains an elongated hollow cylindrical bushing which has an elongated hollow sleeve which fits snugly in an opening in the ceiling tile. A flange is integral with one end of the cylindrical body and seats on top of the surface of the ceiling tile surrounding the opening in the tile. The black jacket is stripped from the free end of the end light fiber optics and is threaded through the cylindrical bushing until its free end protrudes about 1 inch beneath the bottom of the ceiling tile. A trim ring, which can receive a focusing lens is then pressed onto the free end of the cable and into the bushing sleeve to fix the cable and bushing to the tile.

A further feature of the novel bushing structure consists of serrating the bottom end of the bushing to form a circular saw edge. This serrated edge can then be used to cut a circular opening through the ceiling tile which will exactly match the outer diameter of the bushing. The saw edge is covered by the trim ring after installation.

It has been found that the radiation conductor can pick up and respond to external radiation, for example infrared from the lamps in the fixture. For this reason, the "signal sensitivity" of the receiver is reduced so that it is activated only by signals from the remote transmitter. This however slows down the response time of the receiver to coded signals from the transmitter.

In accordance with the improvement of this invention, the receiver circuit is, in essence, switched from an insensitive "wait" state (during which it does not respond to extraneous infrared signals) to an "active" and more sensitive state upon the reception of a valid start signal sequence. Thus, when activated, the system will respond to further signal data more easily. More specifically, each signal train produced by the infrared transmitter contains a start byte of 8 bits and three data bytes or 24 bits. Each of the start bits is sampled 4 times by the receiver, and all 4 samples must confirm that the bit is high (termed 4 of 4 voting) to comprise a valid high bit. If all eight start bits are high, i.e., 32 consecutive high samples, the microcontroller will identify a valid input signal and act on the data signal. However, the next 24 data bits and all succeeding signals are subject to only 3 of 4 voting to be considered valid, thus allowing the control system to operate more smoothly. That is, while all bits are sampled 4 times, only 3 need to be high to consider the bit to be high. The standard remains at 3 of 4 voting if and only if a repeatable command has been decoded (raise light level, lower light level or program mode). If the command is not repeatable (go to 100% light or go to another preset light level), the voting standards are changed back to 4 of 4. Repeatable commands such as raise or lower only cause a small change to the light level. In order to go from a low light level to a high light level, for example, the unit must receive many commands. By relaxing the voting standard, the change is perceived as smoother. This process continues until 1.5 seconds (or any other selected time) has elapsed without a command, and the system then reverts to 4 of 4 voting, termed herein, the "insensitive" state. Note that while the terms used above are "4 of 4 voting" and "3 of 4 voting" respectively, they could more broadly be understood to refer to 100% voting and 75% voting respectively.

As another feature of the present improvement, the receiver housing contains a positive switch for example, relay contacts or a triac or the like in series with the ballast power circuit for switching off its respective ballast. This positive switch is mounted within the receiver housing.

As a still further feature of this invention, the novel receiver structure and circuit is incorporated into the ballast housing, and the radiation signal is brought through an infrared transparent portion, typically, an opening in the ballast housing and into the radiation receiving circuitry. The combination of these two parts within a common housing produces cost and space savings from the common use of circuits and supports and eliminates the external wiring between the two circuits. Thus, a common housing permits the use, for example, of a common power supply, common output drivers and a common printed circuit board.

BRIEF DESCRIPTION OF THE DRAWINGS

FIG. 2 is an elevational view of the receiver/ballast control circuit housing which can employ the present invention.

FIG. 5*a* shows the lens structure on the housing of FIG. 3 as disclosed in earlier application Ser. No. 08/407,696.

FIG. 6 shows one of the conductors of FIG. 5 and shows the detail of its mounting flange and snaps.

FIG. 7 is a top view of FIG. 6.

FIG. 8 is a detailed view of the mounting flange and snaps of FIGS. 6 and 7.

FIG. 20 is a flow diagram of the program installed in the microcontroller of FIG. 1 to prevent operation of the system by stray infrared radiation.

DETAILED DESCRIPTION OF THE DRAWINGS

Figure 1:
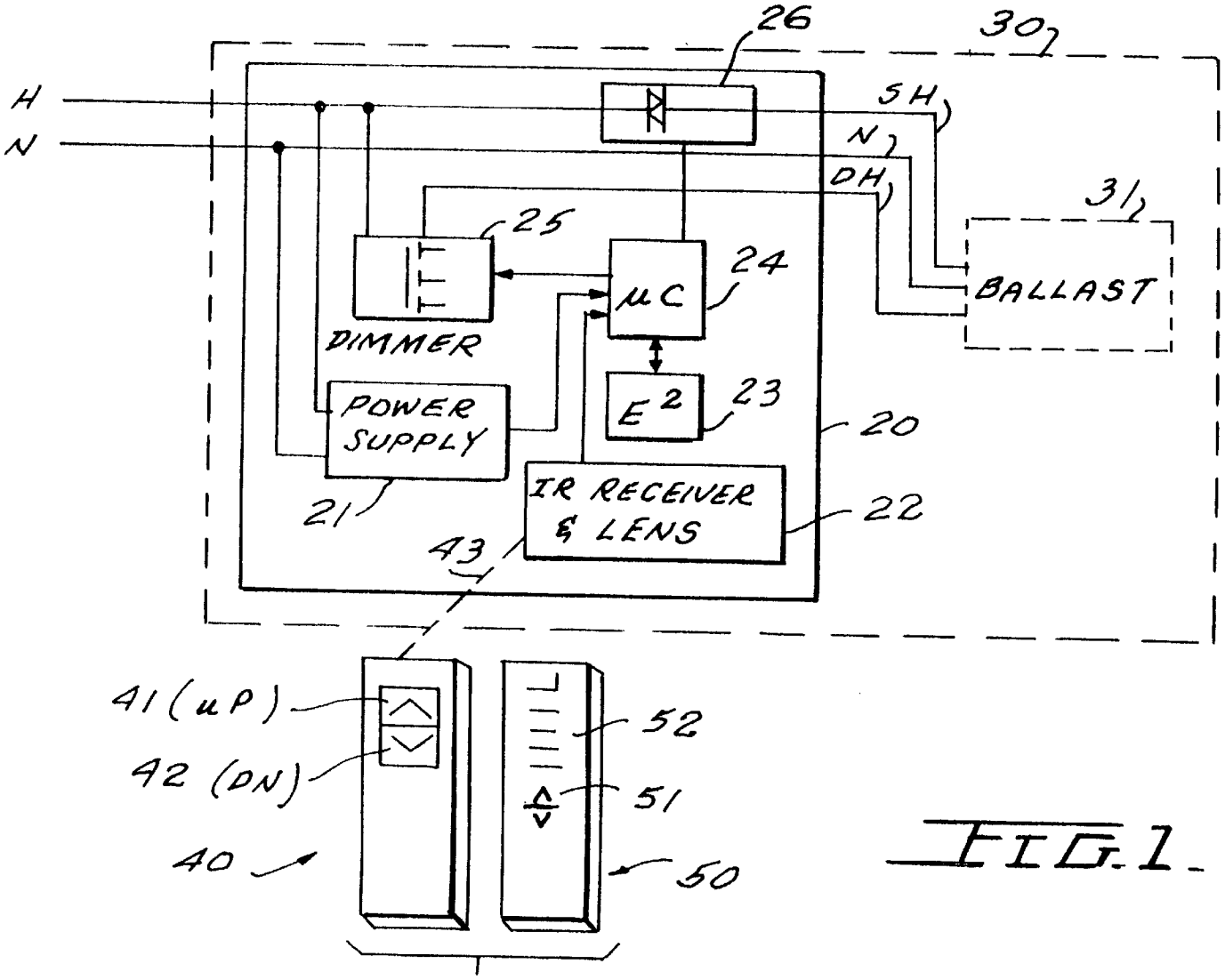
FIG. 1 is a block diagram of the lighting fixture adapted with a radiation receiver/ballast control circuit with remote radiation transmitters and which can employ the present invention.

Referring first to FIG. 1, there is shown a block diagram of the system which incorporates the invention in which a single radiation receiver/ballast control circuit 20 contains a circuit consisting of a power supply 21, an infrared signal receiver 22, an EEPROM circuit 23, a microcontroller 24 and a dimmer circuit 25 which includes an appropriate semiconductor power switching device. An on/off power switching device 26 such as a triac or relay contacts or the like can be included in series with the ballast power wire and is operable from an output from microcontroller 24.

While receiver 22 could respond to any desired narrow band radiation, it is preferably a receiver of radiation in the infrared band.

Radiation receiver/ballast control circuit 20 is mounted within a lighting fixture 30 as will be later described in more detail. Fixture 30 also contains a dimming ballast 31 of known variety which can energize one or more gas discharge lamps, such as 32-watt fluorescent lamps, in a controlled manner. Ballast 31 may be a dimming ballast known as the "Hi-Lume" ballast or the "ECO-10" ballast, each sold by Lutron Electronics Co., Inc., the assignee of the present invention.

Ballast 31 typically has three input leads taken from radiation receiver/ballast control circuit 20, including lead SH (switched hot), lead DH (dim hot) and N (neutral). The ballast can, however, have control arrangements other than those using three input leads. For example, a 0–10 volt control can be used, with its typical four-lead wire system (hot, neutral, purple and gray), as used for low voltage controlled ballasts. Input leads SH (switched hot) and N (neutral) in FIG. 1 are connected to receiver/ballast control circuit 20. Significantly, since receiver/ballast control circuit 20 and ballast 31 are both within fixture 30, all wiring interconnections between the two are also within the fixture.

In order to control the light level of the fixture of FIG. 1, an infrared transmitter of known variety is employed. Thus, two kinds of transmitters are shown in FIG. 1. The first is transmitter 40 which is a known type of raise/lower transmitter. Transmitter 40 is a small hand-held unit which has an "up" control button 41 and a down control button 42. Pressing either of these buttons 41 or 42 will cause the generation of a narrowly focused coded beam of infrared radiation 43 (with an 8° beam angle) which can illuminate the IR sensor in receiver 22 to cause the lamps controlled by ballast to increase or decrease, respectively, their output light.

As will be later seen, a plurality of spaced fixtures 30 in a single room can be individually controlled by a single transmitter 40 from almost any location in most rooms.

A more elaborate transmitter 50 may be used in place of transmitter 40. Thus, transmitter 50 is of the type sold by Lutron for the remote control of wall mounted dimmer controls sold under the trademark, Grafik Eye. The transmitter 50 has an up/down control 51 and a plurality of push buttons 52 which correspond to, and place the ballast 31 in one of a plurality of preset dimmer conditions. Its structure and operation is described in U.S. Pat. No. 5,191,265.

As will later be described, either of the transmitters 40 or 50 may also be used to calibrate the dim settings of the lamps being controlled in the manner described in U.S. Pat. No. 5,191,265. When using the transmitter 50, low end calibration, high end calibration, and other parameter calibrations can be accomplished by pressing combinations of preset buttons 52 to send out appropriately coded signals.

Figure 4:
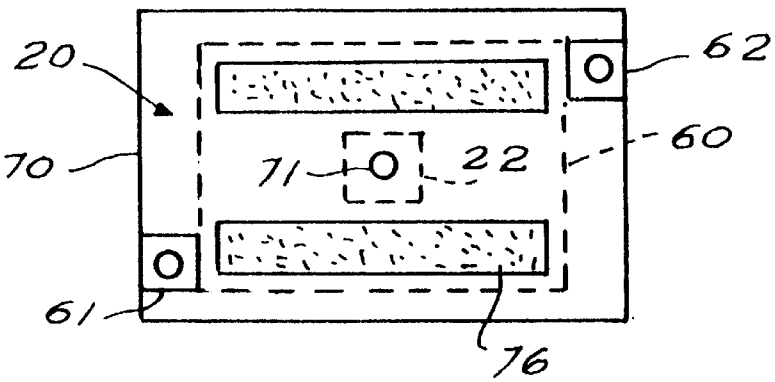
FIG. 4 is a bottom view of the receiver/ballast control circuit housing of FIGS. 2 and 3.
Figure 3:
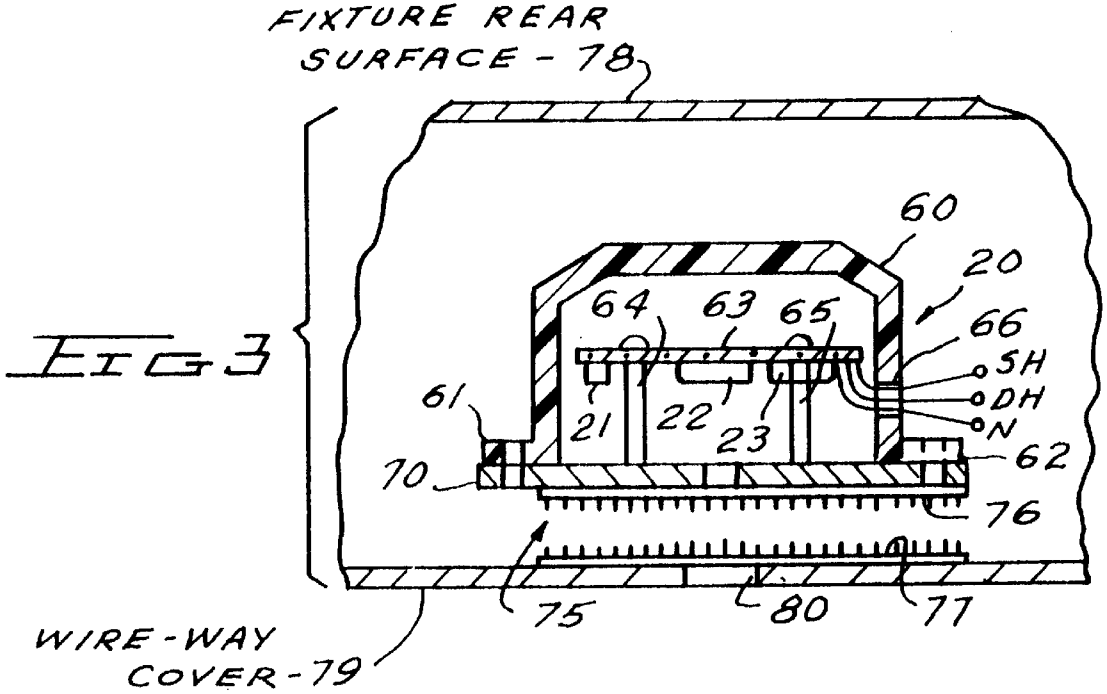
FIG. 3 is, in part, a cross-section of FIG. 2 taken along the section line 3—3 in FIG. 2 and also shows the plastic yoke, fixture rear surface and wire-way cover, and a hook and loop type fastener in a partly exploded view.
Figure 5:
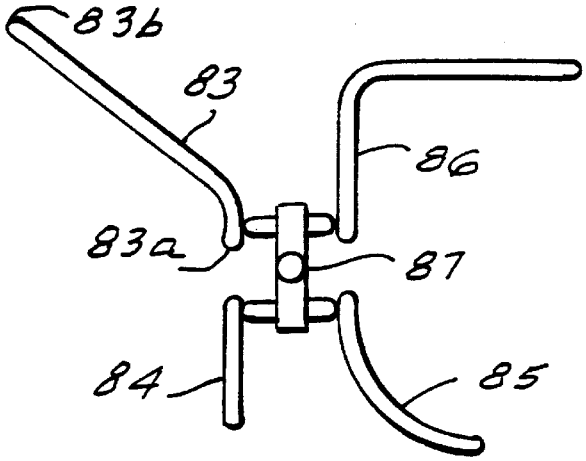

The structure of radiation receiver/ballast control circuit 20 of FIG. 1 is shown in FIGS. 2, 3 and 4. Referring to these figures, the radiation receiver/ballast control circuit 20 is housed in a conventional plastic back box 60 which has projecting mounting ears 61 and 62. A circuit board 63 is mounted to yoke plate 70 on conventional snap-in posts 64 and 65 (FIG. 3). Circuit board 63 carries infrared sensor 22, or an equivalent radiation sensor for the particular carrier used to carry the remote signal and also carries integrated circuits including the power supply 21, microcontroller 24 and EEPROM 23 and, in some cases, the power semiconductor 25 of FIG. 1. Leads SH, DH and N extend through an opening 66 in the housing 60. A further positive on/off switching device can also be added to act as a positive on/off sensor switching device to switch the ballast power.

The side of housing 60 is ordinarily closed by a metal yoke. When using the present invention, the yoke plate 70 is formed of plastic and has a hole 71 cut in it which is transparent to the infrared or other signal carrying radiation which is used. Thus, as shown in FIG. 4, the sensor 22 can be illuminated through plate 70.

In order to mount the housing 60 within a lighting fixture, a novel hook and loop tape (sold under the trademark Velcro) mounting system may be used. Thus, Velcro tape, supplied in reel form, has two cooperating tapes releasably fastened together with a pressure-sensitive adhesive on their outer surfaces. The adhesive surfaces are covered by release strips. Two lengths 75 of such tape are cut to fit over portions of yoke 70 as shown best in FIG. 4. The release strips are removed from upper Velcro strips 76 and the Velcro strips are adhered to the bottom of yoke 70. When the housing 60 is to be mounted, the release strip on the bottoms of tape strips 77 are removed (FIG. 3). The housing 60 is then positioned so that the light sensor 22 is disposed above the radiation receiving openings 80 and 71 (FIG. 3) in wire-way cover 79 or on some other portion of the fixture. The lower strip is then pressed into contact with the rear interior surface of the lighting fixture wire-way cover 79 (FIG. 3). Other fasteners can be used such as bolts, rivets, magnets, double-sided tape and the like to fix housing 20 to the fixture 30.

Figure 5:
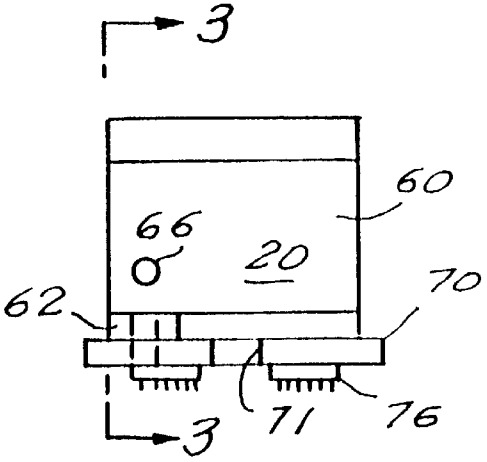
FIG. 5 shows 4 differently shaped plastic radiation conductors or lenses fastened to a common mold sprue.

In the structure disclosed in above-noted patent application Ser. No. 08/407,696, a snap-in infrared lens 81 was snapped into opening 71 as shown in FIG. 5*a*. The lens 81 is designed to have any desired angle of acceptance of incident radiation, and hence different lenses may be used to suit the requirements of a particular application. For example, the lens 81 may be a fresnel lens 82 so that infrared radiation coming toward lens 81 from even very shallow angles to the ceiling surface will be refracted along its axis and toward sensor 22, through hole 71 in yoke 70.

The above noted application Ser. No. 08/407,696 also discloses that a light (infrared) conducting fiber can convey sensed radiation to the sensor 22 if the sensor 22 is removed from the receiver.

In accordance with one aspect of the present invention, the fresnel lens 82 is replaced by an elongated light conductor 83 (FIGS. 5 to 9 and 9*a*). Lens 83, in a preferred embodiment of the invention, is a molded plastic lens which may be co-molded with a plurality of other lenses of diverse shape, such as lenses 84, 85 and 86 in FIG. 5 which share a common sprue 87 from which they can be easily removed. The lens 83 is preferably made from an acrylic plastic. Other plastics can be used, for example, polycarbonates, which conduct the sensed radiation used in the system from an exterior end to an interior end near a radiation sensor. The assemblage of 4 lenses 83 to 87 can be shipped to all customers, who will select the shape best adapted to their installation, as will be later discussed. Note that the lens 83 has a radiused end 83*a* and a square end 83*b*. Unexpectedly, best performance has been observed when the radiused end 83*a* faces the radiation sensor 22 (see FIG. 9) and the square end 83*b* is the end facing outwardly of the fixture as will be described.

Figure 9A:
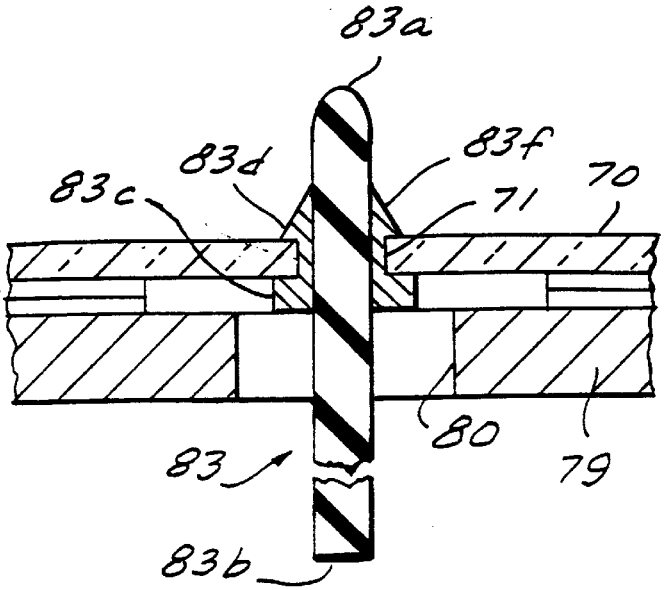
FIG. 9*a* is an enlarged detail drawing of the connector structure of FIG. 9.
Figure 9:
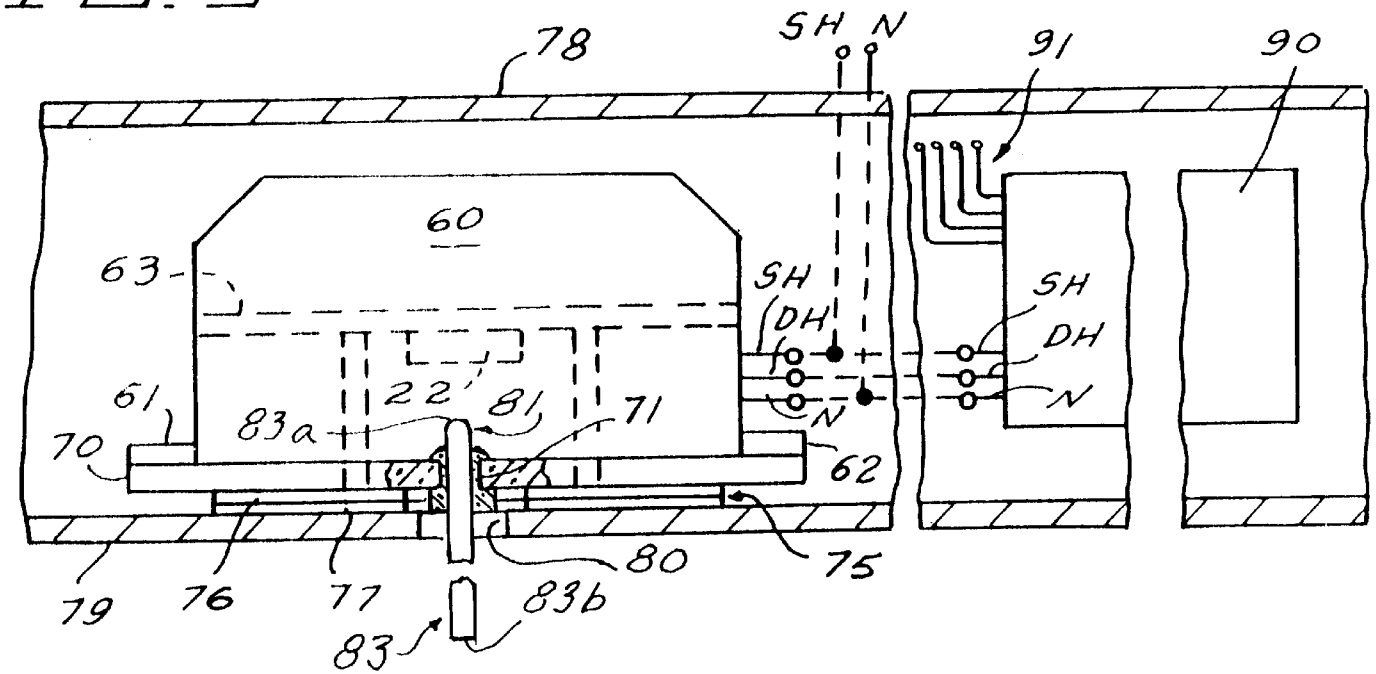
FIG. 9 is a partial cross-sectional view showing the receiver/ballast control circuit of FIG. 3 with the lens of FIGS. 6 and 7 located within the wire-way of the fixture, and connected internally of the fixture to the dimming ballast leads.
Figure 9A:
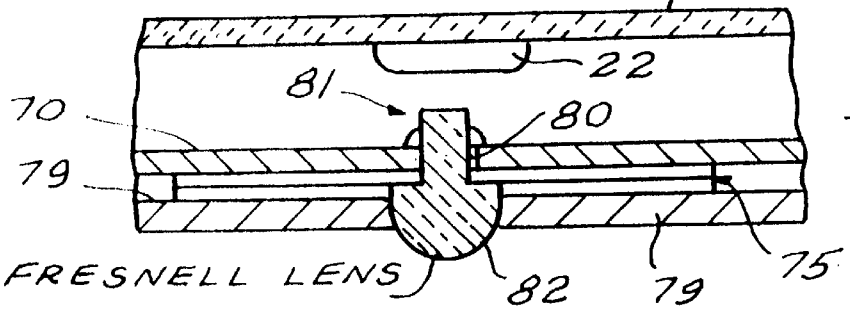

FIG. 9 shows receiver housing 60 fixed in position between a fixture rear surface 78 and wire-way cover 79 as previously described. FIG. 9 also shows the dimming ballast 90 which is also fixed to fixture surface 78 in any suitable manner. Ballast 90, which may replace a non-dimming ballast in a retrofit installation, has three input leads SH, DH and N which are conveniently connected to corresponding leads from radiation receiver/ballast control circuit 20 within the fixture interior. Output ballast leads 91 are connected to the lamps.

Ballast 90 can be any desired dimming ballast, for example, the Lutron® Hi-Lume® ballast.

During the retrofitting operation, the installer need only drill the small hole 80 in the wire-way cover 79. The ballast 90 and radiation receiver/ballast control circuit 20 are then easily installed and wired together and the wire-way cover is reinstalled with lens 83 aligned to the position of hole 80 in wire-way cover 79. Thus, retrofitting is easily done in a short time.

In accordance with the preferred embodiment of this invention, the elongated lens, for example lens 83 of FIGS. 5, 6, 7 and 8, is arranged to snap into the opening 71. One alternative is to have it rotatable into the opening 71 to enable lateral movement of end 83*b* for reasons to be later described. The snap-in structure is enabled in any desired manner. For example, lens 83 may be molded with a flange 83*c* (FIGS. 6 to 8 and 9*a*) and with spaced projections or snaps 83*d*, 83*e* and 83*f* (FIGS. 8 and 9*a*). The projections can be forced through opening 71 to snap over the top of plate 70 to hold flange 83*c* against the bottom surface of plate 70. However, the fit is sufficiently loose to allow the rotation of lens 83 within opening 71.

In one embodiment of the invention, the molded lens 83 had a length from flange 83*c* to end 83*b* of about 4 inches, with the bottom section from flange 83*c* to end 83*a* being about 0.45 inch. The diameter of the rod 83 was about 0.248 inch and the diameter of flange 83*c* was about 0.348 inch and its axial length was about 0.050 inch. The space between flange 83*c* and the plane of the facing surfaces of projections 83*d*, 83*e* and 83*f* was about 0.060 inch. The projections are tapered barbs having a length of about 0.030 inch and a height of 0.015 inch. The end 83*a* had a radius of 0.125 inch.

It should be noted that other connection structures could be employed. For example, a friction fit could be used, and a permanent bolted arrangement could be employed. Preferably, the same fit is used for any of the molded lenses of FIG. 5 or of a fiber optic cable if one is used so that the connection of housing 60 to external optics is universal.

Figure 11:
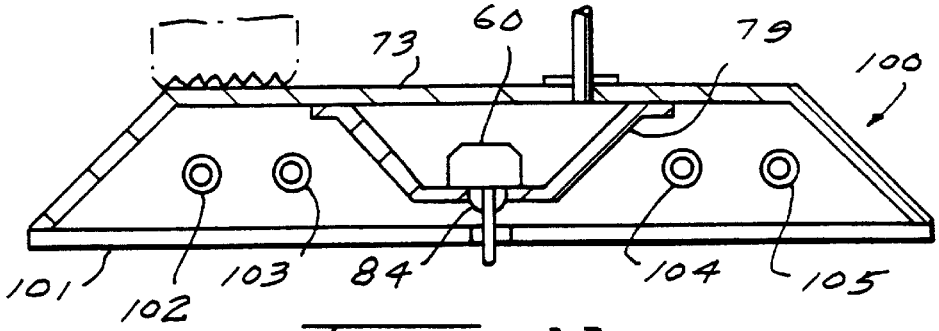
FIG. 11 is a cross-section of FIG. 10, taken across the section line 11—11 in FIG. 10.
Figure 10:
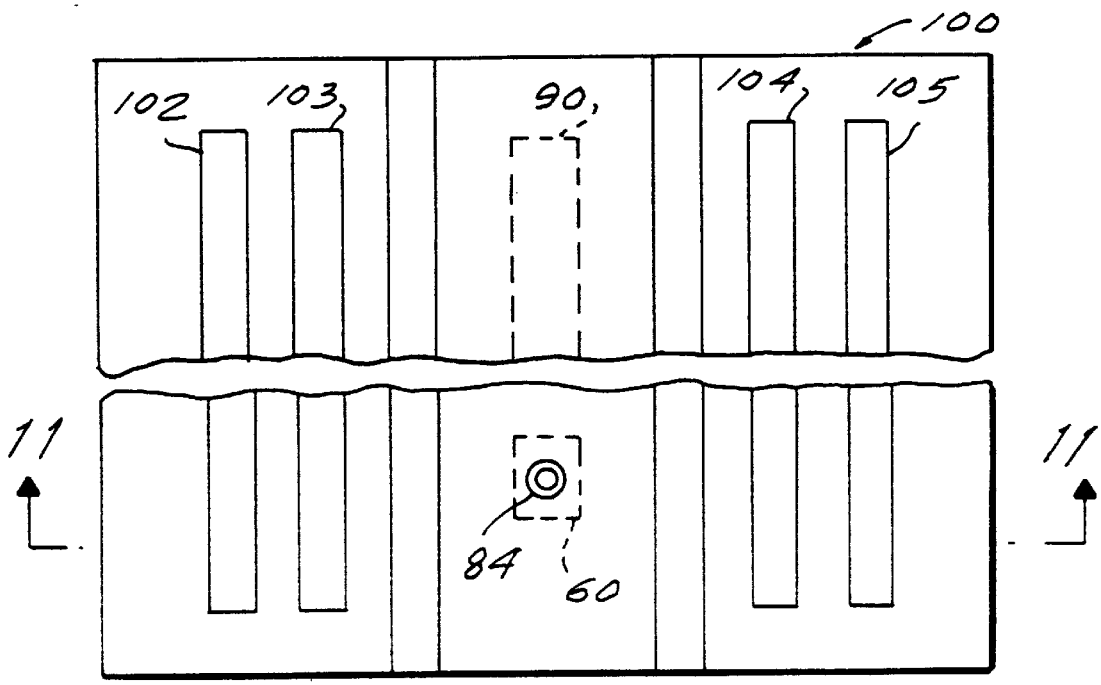
FIG. 10 is a view of the bottom or light output side of a fluorescent light fixture with a prismatic lens which contains the novel infrared receiver of the invention.

FIGS. 10 and 11 show a conventional fluorescent light fixture 100 with a prismatic lens cover 101. A typical fixture of this type will be two feet wide and four feet long and will contain four 32-watt fluorescent bulbs 102, 103, 104 and 105. All wiring and the ballast 90 for the lamps is contained behind wire-way cover 79 which may be bolted or otherwise fastened to the fixture rear 78. Ballast 90 and radiation receiver/ballast control circuit 20 are contained within the fixture so that wiring connecting the two is not exterior of the fixture. Moreover, in accordance with the invention, the lens 84 projects out of the plane of the bottom surface of the lens cover 101 and through an opening in the lens cover, or in its support. Note that in FIG. 11 the rod 84 is straight. However, if the housing 60 were mounted on the side of cover 79, the lens 83 would be used, with its elongated portion projecting vertically. By having the end of the lens project beyond the surface of lens cover 101, any shadowing effect of the lens to line of sight radiation, and unanticipated reflection is eliminated. Thus, better operation is experienced by having the end of the rod 84 either flush with, or protrudes beyond the bottom plane of lens 101. Best results have been found with the lens protruding about ½", but it can protrude by other distances.

In the case of prismatic lenses, it has also been found that improved operation is also obtained if the end of radiation conducting rod lens 84 is located close to the top surface of the lens cover 101 to avoid the need for cutting an opening in the lens cover 101. Further improved sensitivity may be obtained if rod 84 is shielded, as by shield 504 of FIG. 12*a*. Shield 504 has a focusing end 506 which can be conical or parabolic to focus desired IR signals onto the end of rod 84.

Figure 13:
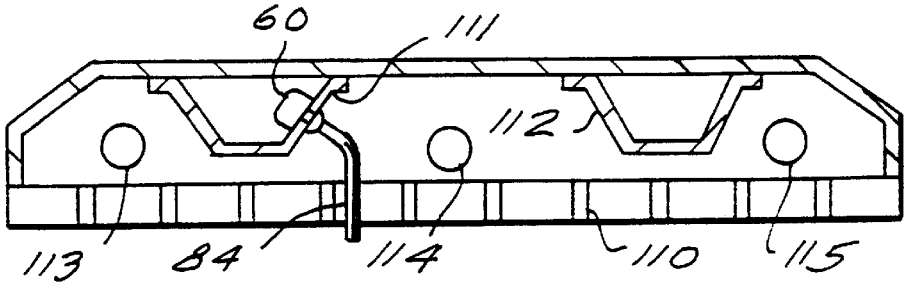
FIG. 13 is a cross-section of a fixture like that of FIG. 11 but with a parabolic louver instead of a prismatic lens and shows the manner in which the radiation receiver protrudes through the bottom plane of the lens.

The invention can be applied to many other types of fixtures. For example, FIG. 13 shows a fluorescent light fixture with a louver or parabolic lens cover 110 in place of the prismatic lens 101 of FIG. 11. The fixture of FIG. 13 has two wire-way covers 111 and 112 for three lamps 113, 114 and 115. The ballast (not shown) and the radiation receiver/ballast control circuit 20 are mounted within cover 111. The radiation receiver/ballast control circuit 20 is preferably mounted on one of the sloped sides of cover 111. Its lens 83, in accordance with the invention, projects to or beyond the plane of the bottom of lens cover 110 to be free of any shadowing or reflection of the line of sight radiation from the remote transmitter of FIG. 1 at lens 83. Note that lens 83 can be rotated to any position necessary. Best results have been obtained with the lens protruding about ½", but it can protrude any amount.

Figure 12A:
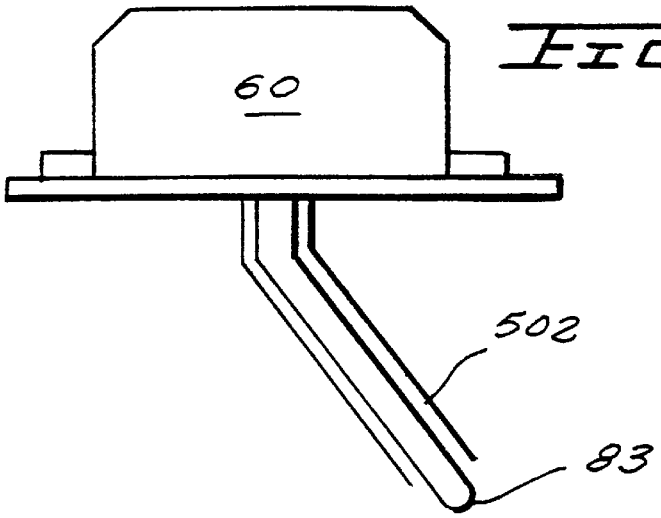
FIG. 12*a* shows a novel radiation receiver/ballast control with an infrared shield covering the radiation conductor except for its very tip.
Figure 12B:
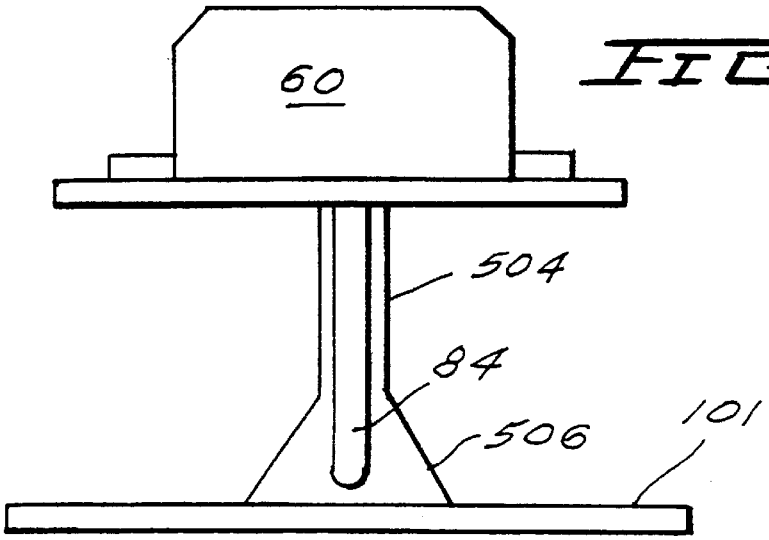
FIG. 12*b* shows a radiation receiver/ballast control with an infrared shield and focusing cone.

FIG. 12*a* shows a further improvement wherein lens 83 is covered with an infrared shield 502 except for the very end which is exposed. This blocks unwanted direct IR radiation from the lamps from reaching the IR sensor, but allows desired IR signals to be received at the exposed end and conducted along rod 83 to the IR sensor. This IR shield is shown with the bent rod 83, but can be used with a rod of any shape.

Figure 14:
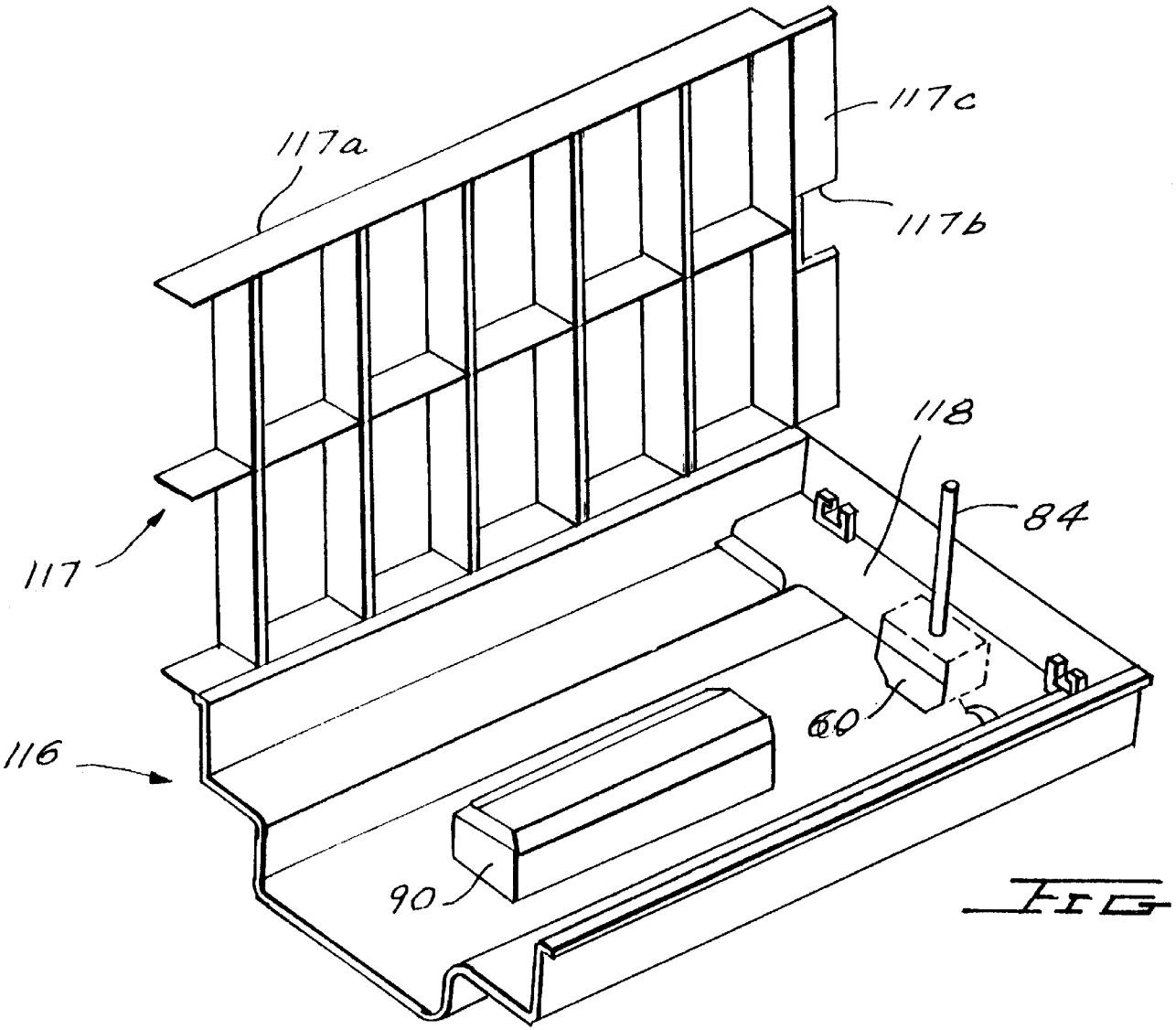
FIG. 14 is a perspective view of an alternative type of fixture with a parabolic louver showing an alternative placement of the radiation receiver/ballast control circuit and its infrared conductor rod.

FIG. 14 shows a fixture 116 with a pivotally mounted louvered lens cover 117, shown in the open position. A ballast 90 is fixed to the interior of the fixture. A housing 60 is then fixed to the bottom of end channel 118, and a straight plastic lens 84 extends outwardly and is of sufficient length to extend to or beyond the bottom plane 117*a* of the lens cover 117 when the cover is closed. A cut-out 117*b* is formed in the lens cover flange 117*c* to permit opening and closing of the lens cover 117 and permits the lens 84 to protrude through the cover 117 when closed and to provide sufficient clearance to open the cover 117 without disconnecting lens 84.

Figure 15:
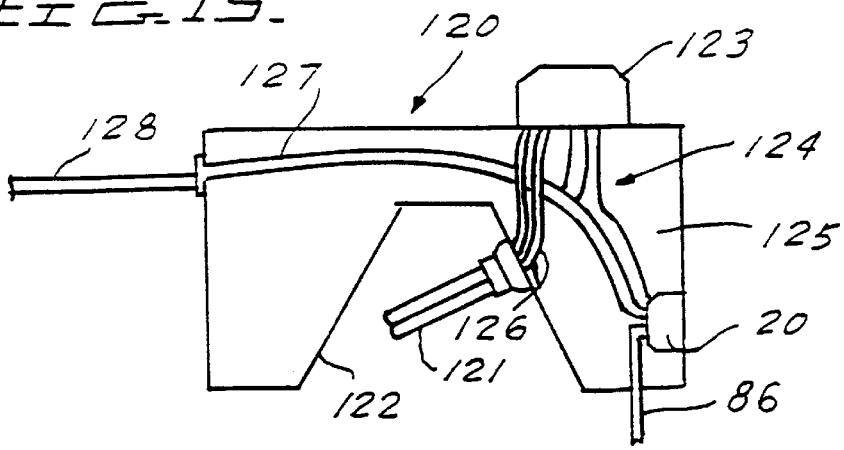
FIG. 15 is a schematic cross-section of a compact fluorescent down-light fixture equipped with the receiver/ballast control circuit and the radiation receiver of the invention.

FIG. 15 shows the manner in which the invention may be applied to a compact fluorescent down-light fixture housing 120. Thus, a compact fluorescent lamp 121 is contained within reflector 122. A dimming ballast-123 is fixed to the exterior of housing 120 and its input wires 124 (SH, DH and N leads) are connected to related output wires 125 of radiation receiver/ballast control circuit 20. Radiation receiver/ballast control circuit 20 is mounted internally of fixture housing 120 as desired and lens 86 protrudes through an opening in housing 120 to be exposed to infrared signal illumination. The wiring connections between radiation receiver/ballast control circuit 20 and ballast 123 are made within the interior of housing 120. The output wiring 126 from ballast 123 to lamps 121 is also contained within the interior of housing 120. All input power lines (Switched Hot and Neutral) 127 come into housing 120 through wiring conduit 128. Thus, as in the prior embodiments, an unobtrusive infrared sensor is fixed to or retrofitted into an existing fixture 120 and all wiring connections are kept within the interior of housing 120.

Figure 16:
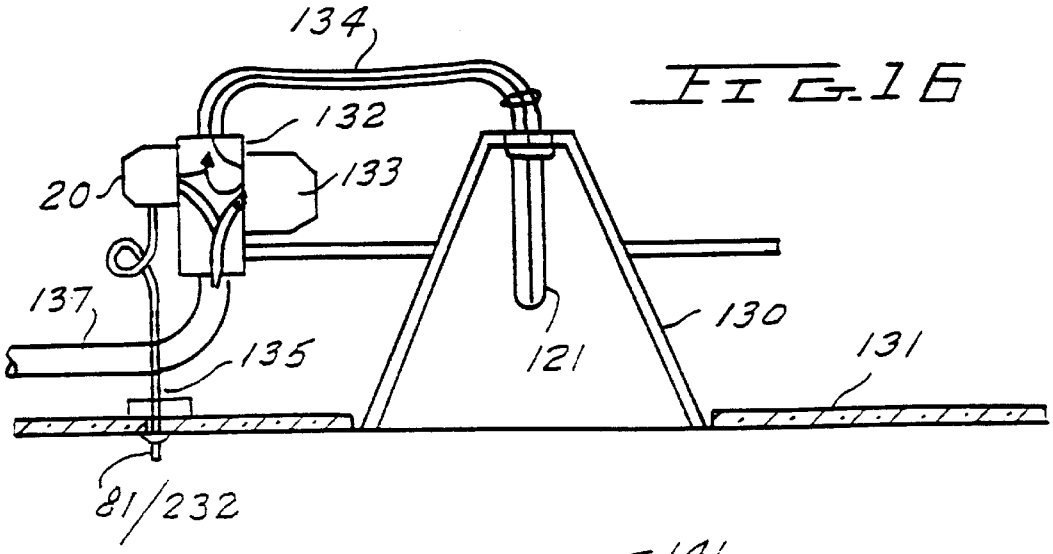
FIG. 16 is a schematic cross-section like that of FIG. 15 of a modified compact down-light fixture containing the receiver/ballast control circuit and the novel end light fiber optics of the invention.

FIG. 16 shows another type of fixture for compact fluorescent lamp 121 and a novel means for bringing the infrared signal to the sensor in housing 60. Thus, the housing 130 is a cone which is suitably mounted flush with the ceiling tiles of a ceiling 131. A wiring box 132 is fixed to cone 130 and a dimming ballast 133 and radiation receiver/ballast control circuit 20 are mounted on opposite sides of box 132 and are interconnected within the box 132. Input power is brought into the fixture via metal conduit 137 and the output lines to lamp 121 are contained within conduit 134. Since this structure physically removes radiation receiver/ballast control circuit 20 from the area of ceiling 131, a "light pipe" 135 which terminates at lens 81 is snap-mounted into the ceiling tile 131.

Figure 16A:
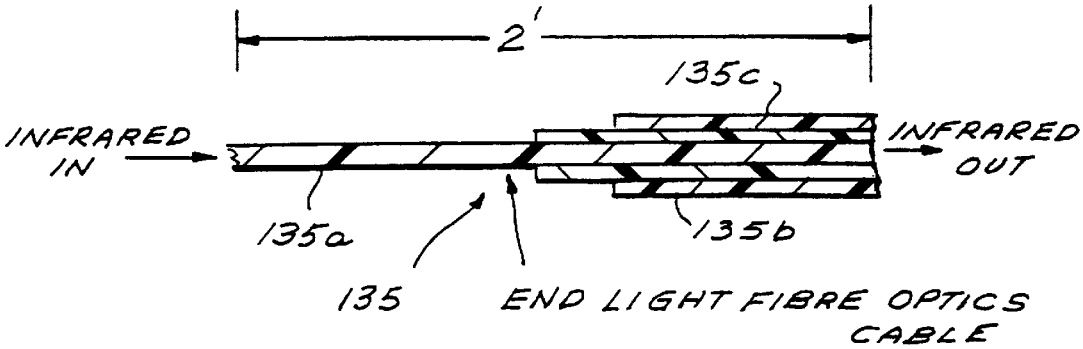
FIG. 16*a* is a cross-sectional view of a known end light fiber optics for conduction of visible light.

The light pipe previously used has been a flexible fiber optics line with connection ferules at either end. Such structures are quite expensive. In accordance with an important feature of the invention, a much less expensive flexible conductor is used for light pipe 135 which was previously thought useful only for visible light rather than infrared at 880 nanometers. Thus, in accordance with the preferred embodiment of the invention, and as shown in FIG. 16*a,* end light fiber optics is employed for light pipe 135 which consists of a silicon monomer gel core 135*a* wrapped with a Teflon® sheath 135*b* and a black plastic jacket 135*c*. The Teflon® sheath 135*b* is employed to ensure internal reflection as radiation traverses the length of the core 135*a* and the black jacket 135*c* is employed to shield the core 135*a* from ultraviolet light which tends to cause the core 135*a* to yellow. The gel core which has a diameter, for example, of ⅛ inch was believed to attenuate infrared severely and could not be used for infrared transmission. We have found that lengths up to 24 inches of such light pipes transmit ample infrared at 880 nanometers to be perfectly adequate for use in most systems.

In the preferred embodiment of FIG. 16, the line 135 is an end light fiber optics, for example, part No. EL 100 sold by Lumenyte International Corporation. It has a length less than about 24 inches and a minimum bend radius of about 1 inch. The material is much less expensive than convention infrared fiber optics with connection ferrules.

Figure 17:
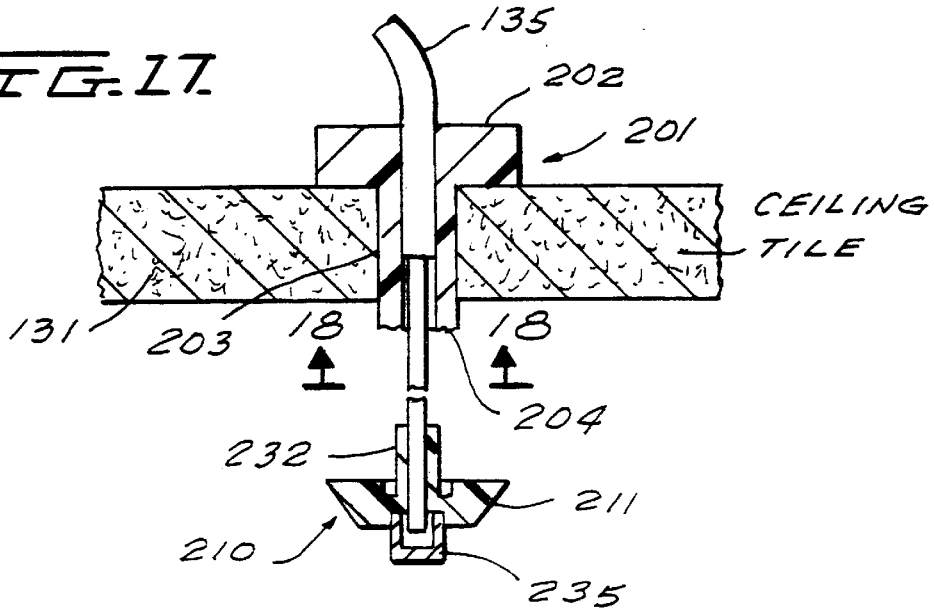
FIG. 17 is an exploded cross-sectional view of the mounting bushing which mounts the end light fiber optics of FIG. 16 to the ceiling tile.
Figure 18:
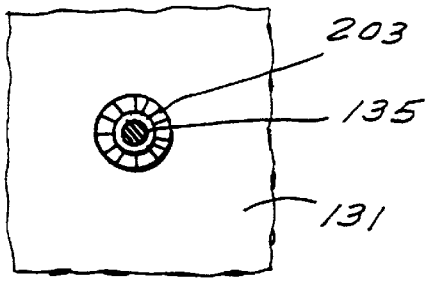
FIG. 18 is a cross-section of FIG. 17 taken across section lines 18—18 in FIG. 17.

Another significant feature of the invention involves the connector structure 200 (FIGS. 16, 17 and 18) employed for connecting light pipe 135 to the ceiling tile 131. The novel connector consists of a plastic bushing 201 having a flange end 202 and a thin integral rigid extending hollow cylinder 203. The cylinder 203 may have a serrated or saw-tooth end 204 so that the bushing 201 can be used by hand oscillation about its axis, to cut a hole in the tile 131 which will snugly receive the cylinder 203 used to cut the hole.

Flange 202 has a central opening which snugly receives the outer diameter of a short length of light pipe 135. The black jacket 135*c* (FIG. 16*a*) is removed from the light pipe for an end portion of its length that fits through bushing 201.

An external coupler 210 or trim ring, which is a molded plastic part, has a finishing flange 211, adapted to cover the end of cylinder 203 and the opening in tile 131 and press against the bottom of ceiling tile 131. Ring 210 has a hollow central extension 232. The external diameter of extension 232 snugly into the interior of sleeve 203 while the end of light pipe 135 fits through the center of and beyond the bottom of ring 210. A plastic red fresnel lens 235 (which is like lens 81 of FIG. 5*a*) fits snugly into the bottom of fitting 210 to cover the free input end of light pipe 135. The fitting 210 will fit against the bottom surface of tile 131 when assembled, as shown in FIG. 16.

Figure 22:
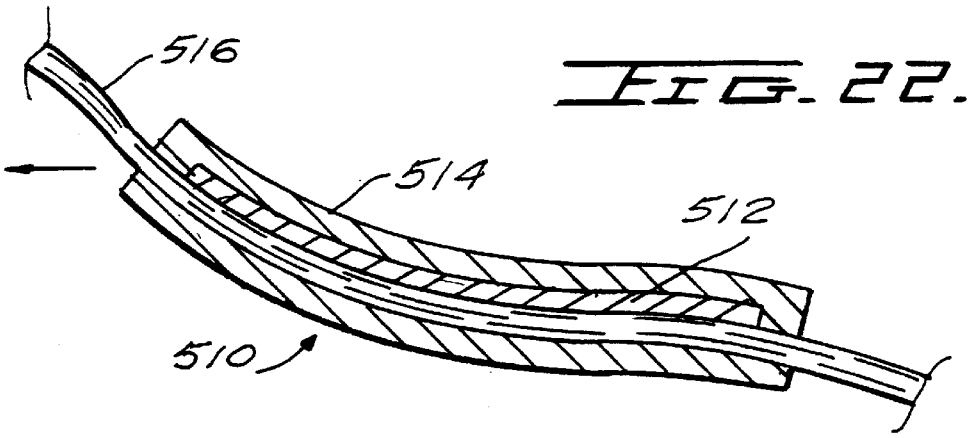
FIG. 22 shows a semi-rigid lightpipe structure.

FIG. 22 shows a novel semi-rigid optical structure. This combines features of the rigid lenses 83–86 with those of the flexible light pipe 135. The rigid lenses do not require the free end to be secured, but the position of the free end is predetermined by the shape of the lens. On the other hand, the free end of the flexible light pipe can be placed in any location, but must be secured in order to maintain a given position.

The novel semi-rigid optical structure illustrated in FIG. 22 is constructed so that it can be bent by hand to place the free end at any desired location for best reception of an IR signal and will retain that position without having to be secured.

The novel light pipe 510 is similar to light pipe 135 with the addition of a semi-flexible wire 512 which is positioned under shielding 514. Wire 512 is semi-flexible and the entire assembly can be bent to any desired shape by hand. However, the assembly is still rigid enough that, when the bending force is removed, the assembly is self-supporting and retains the desired shape in the manner of a pipe cleaner.

Figure 23:
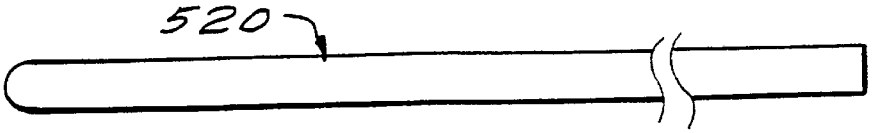
FIG. 23 shows another semi-rigid lightpipe.

FIG. 23 shows another novel semi-rigid optical structure. This structure also has the flexibility of the flexible light pipe and the ability to maintain a given position like the rigid lenses.

The novel semi-rigid optical structure illustrated in FIG. 23 is of similar material to the rigid lens 83 (e.g., an acrylic plastic) but the polymerization process has been shortened to allow the lens to be flexible and also maintain a given shape without the need for the semi-flexible wire 512.

In a preferred embodiment, a copper wire 512 of #16 AWG has been found to provide adequate stiffening but still allows the light pipe 510 to be semi-flexible and bendable by hand to a given desired permanent position. The copper wire is shown in parallel with the fiber, but it could be wrapped around fiber or made into a continuous shield. Materials with similar properties to copper can be used.

Figure 19:
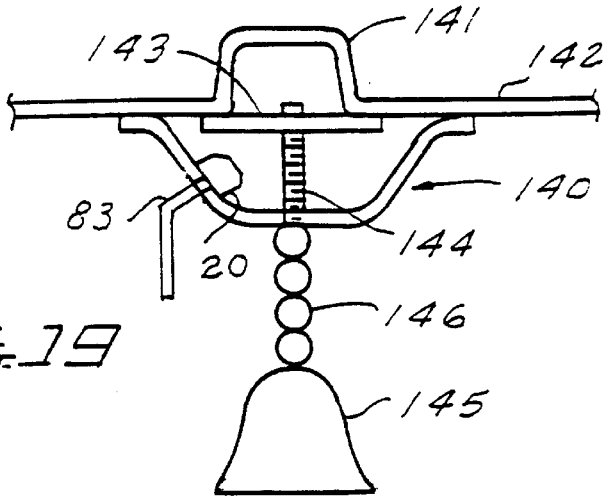
FIG. 19 schematically shows the application of the novel invention to an incandescent canopy fixture.

The present invention can also be applied to incandescent lamp ceiling fixtures, as shown in FIG. 19. Thus, in FIG. 19, an incandescent canopy fixture 140 includes a wiring box 141 fixed to ceiling 142. A support plate 143 extends across box 141 and receives a hollow threaded screw 144 which supports a lamp holder 145 from chain 146. In accordance with the invention, a radiation receiver/dimmer housing 20 having a lens 83 protruding external of housing 140 is mounted within the housing 140. Power wiring from box 141 is connected to radiation receiver/dimmer 20 which contains a power semiconductor dimmer (25 in FIG. 1) which is controlled by infrared signals received through lens 83. Output wiring from radiation receiver/dimmer 20, including the dim hot and neutral wires, extends through the center of support screw 144 to the incandescent lamp or lamps in holder 145.

It will be apparent that incandescent lamp fixtures distributed over the surface of a ceiling can each be adapted as shown and described in FIG. 19 to be selectively dimmed to suit individual users in different locations in the room. Moreover, such lamps can be mounted on centers greater than about two feet and still be discriminated from one another by an infrared transmitter having a beam dispersion of about 8°. It will also be apparent that the novel receiver of the invention can also be used on wall sconces and lamp cords and the like, as well as on recessed incandescent downlights similar in design to those of FIGS. 15 and 16 but designed for use with incandescent rather than fluorescent lamps.

Further, the invention can be applied to track lighting fixtures where the receiver/dimmer is built into an adaptor which mounts to the track and the fixture to be controlled is mounted to the adaptor.

A single receiver can control a plurality of ballasts which are in spaced fixtures. Fixtures equipped with the receiver of the invention can be used with added inputs, such as photocell detectors for adjusting lamp intensity in accordance with ambient light. Furthermore, the novel receiver can also be used with external dimming controls in which dimming of lamps can be accomplished under the control of an infrared transmitter, an occupancy detector, or a manual control or timer or the like as is described in copending application Ser. No. 08/407,696.

As a further feature of the present invention, a novel control is employed for the microcontroller 24 which increases the sensitivity of the system to input infrared data signals. More specifically, since there is extraneous infrared in the ambient coming, for example, from the light being controlled and other sources, means are necessary to ensure that a valid signal was received from the remote transmitter before a change was executed. In the prior (and present) system, the infrared signal consists of a continuing sequence of 8 start bits, followed by 24 data bits. To ensure the presence of valid signals, each of the bits is sampled four times to see if they are high. All four samples must be high for the bit to be considered high. This system is termed "4 of 4 voting". If all eight of the start bits are high (i.e., 32 consecutive high samples), the system recognizes a valid start bit. The voting is then relaxed to a more sensitive "3 of 4 voting" standard. The system remains at 3 of 4 voting if and only if a repeatable command has been decoded (raise or lower light level or program mode). If the command is not repeatable, the voting returns to 4 of 4. The system then acts with the 3 of 4 voting standard until no new data is received or until 1.5 seconds have elapsed since the last command was received. Thus, the system will revert to an "insensitive" state when no valid signal is present (and thus is less responsive to spurious infrared signals) but will be more sensitive in the presence of a valid signal.

FIG. 20 is a flow chart of the novel system described above. In FIG. 20, at the start, the processor operates with a 4 of 4 voting standard. Data enters the sample infrared port 300, and the 4 of 4 determination is made with respect to the first 8 start bits of whether all 32 samples (4 for each bit) have been high (block 301). If so, a determination is made that a valid start byte has been detected (block 302). The microcontroller then relaxes the voting standard to 3 of 4 voting (block 303) and the next 24 bits (data bits) are sampled with the relaxed standard (block 304). The data received is decoded and acted upon (block 305).

A determination is next made of whether the data is for a repeatable command (block 306). If it is, the system continues to sample with 3 of 4 voting, looking for the next start byte (block 307). If not, the system reverts to the 4 of 4 voting standard.

Once 1.5 seconds (or any other desired time lapse) has gone by without a command, the system will revert to the "insensitive" 4 of 4 voting standard (block 308). However, if a new start byte is detected, the system remains in the 3 of 4 voting standard (block 309).

Describing the above operation further, it will be noted that the system is constantly sampling its IR port. The sampling occurs at a rate that will yield 4 samples per transmitted bit. When the system is in its insensitive state, four adjacent samples must be high if the microcontroller is going to consider a bit high.

The system stays in its insensitive state until it has received 32 consecutive high samples (8 high bits). After the 32nd high sample, the system has interpreted a start bit, and relaxes the voting standards to 3 of 4 (3 out of the last 4 or 4 out of the last 4 samples must be high to interpret a high bit).

The voting standards remain at 3 of 4 until the 24 bits of data information are received and decoded. The standards remain at 3 of 4 if and only if a repeatable command has been decoded (raise or lower light level or program mode). If the command is not repeatable (go to 100% light or go to lowest light level), then the voting standards are changed back to 4 of 4.

When the system receives a raise lights command, only a small change is made to the light level. The system must receive many raise commands to get the light to go from low to full light output. Relaxing the voting standards after the first raise command has been issued makes it easier for the system to receive additional raise or lower commands.

After 1.5 seconds have elapsed after the last repeatable command, the voting standards are put back to 4 of 4 voting to prevent false start byte triggers.

The reason for moving to 3 of 4 voting for repeatable commands is to make dimming appear smooth. There would otherwise be interference when changing light levels and the system would have gaps in the repeatable command stream.

Figure 21:
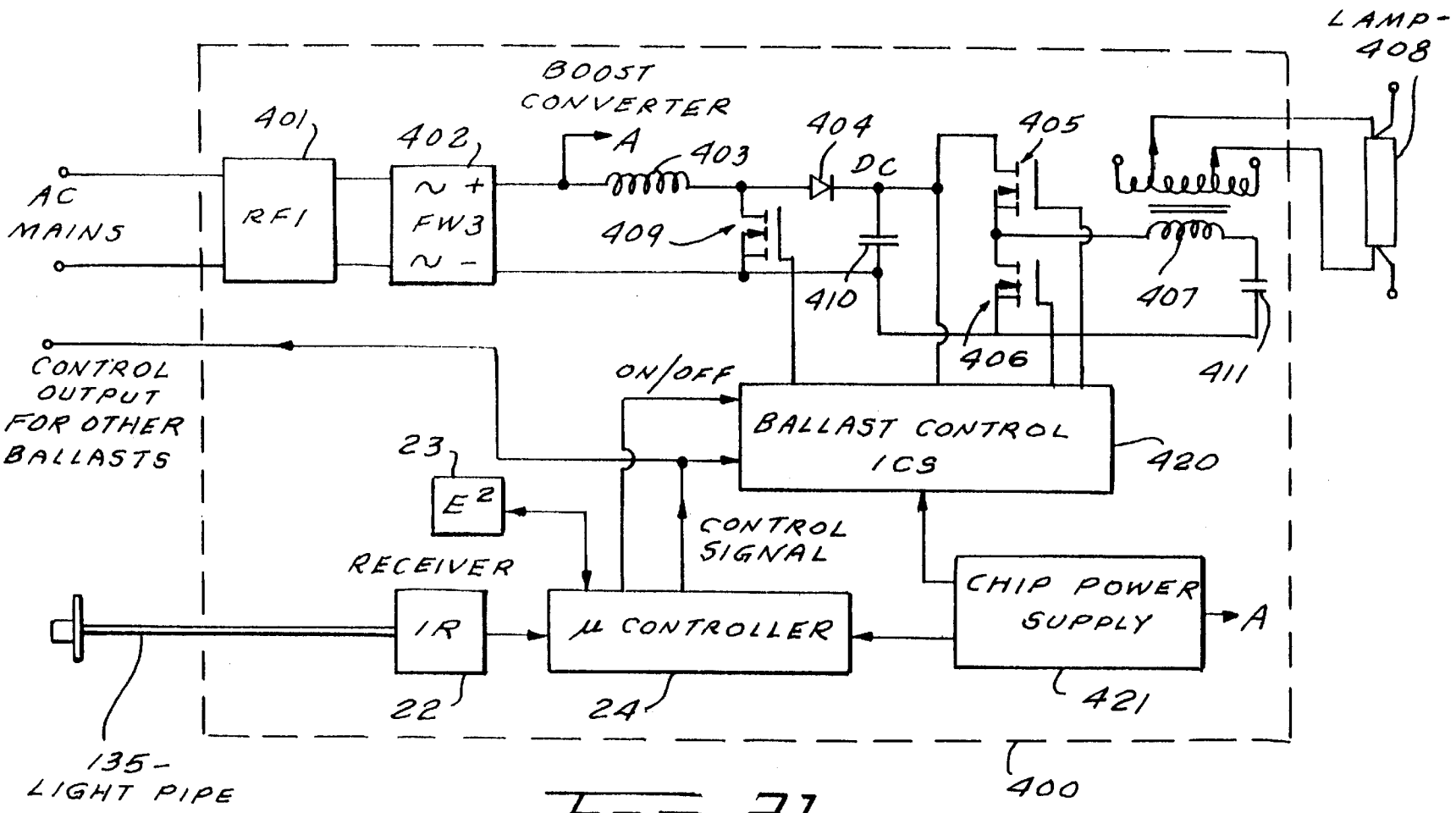
FIG. 21 is a block diagram showing the receiver circuit and ballast circuit integrated into a common housing.

As another important feature of the invention, and as shown in FIG. 21, the ballast 31 and the radiation receiver ballast control circuit may be combined in a common single housing and share a common power supply and other commonalities. The novel combination is shown in FIG. 21 in block diagram and schematic form. More specifically, in FIG. 21, all components are mounted within a common housing 400, shown in dotted line, and having approximately the same volume as the housing for ballast 31 of FIG. 1. The wall of housing 400 is penetrated by a light pipe 135 of structure similar to that of FIG. 16, although any desired light receiver including those of the other preceding figures and of application Ser. No. 08/407,696 could be used. The light pipe 135, however, is preferred because of the usual remote location of the ballast in the fixture.

The components within the housing 400 will include an RF1 filter 401 connected to the a-c mains and a rectifier 402. The d-c output of rectifier 402 is connected through inductor 403 and diode 404 to the inverter comprising MOSFETs 405 and 406. The node between MOSFETs 405 and 406 is connected to ballast transformer 407 which is coupled to the fluorescent lamp 408 or plural lamps, as desired. Capacitor 411 is in series with inductor 407 and resonates therewith at the desired frequency at which lamp 408 is driven. A further MOSFET 409 and capacitor 410 are provided for the conventional boost converter shown. A ballast control IC 420, which is a MOSFET driver, is provided to control the MOSFETs 409, 405 and 406 in an appropriate and known manner. The driver 420 is controlled, in turn, by microcontroller 24 (FIG. 1).

All of the structure given above, except for the microcontroller 24, are parts of the conventional ballast 31 of FIG. 1. Also included within the housing of ballast 31 is a power supply for driving the control ICs 420. A power supply for ICs 420 is shown in FIG. 21 as power supply 421. Power supply 421 derives its power from the positive output terminal of power supply 402, shown as the output line "A" which is connected to the input of chip power supply 421. The receiver structure in FIG. 21 also has the IR receiver circuit 22, microcontroller 24 and $E^2$ 23 within the housing 400.

In accordance with the invention, the placement of the components of receiver 20 of FIG. 1 results in economies of commonality of components and a reduction of space. Thus, the same power supply 421 for ballast control 420 can also serve the purpose of power supply 21 of FIG. 1. Further, a single circuit board could be used for all circuits. Finally, the separate housing 60 of FIGS. 2, 3 and 4 is eliminated.

In a further improvement, microcontroller 24 and ballast control IC 420 can be combined together to further reduce cost.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A radiation receiver structure for receiving and processing an infrared signal, the radiation receiver structure comprising a radiation receiver; said radiation receiver comprising:

an infrared responsive circuit component;

a control circuit coupled to said infrared responsive component for producing an output related to signal information contained in the infrared signal received by said radiation receiver;

a housing; and an infrared conducting member extending through said housing and supported by said housing and having a fixed end disposed adjacent said infrared responsive circuit component and a free end disposed exteriorly of said housing for the reception of an infrared signal.

2. The receiver structure of claim 1 wherein said infrared conducting member is a plastic rod.

3. The receiver structure of claim 2 wherein said plastic rod is straight.

4. The receiver structure of claim 2 wherein said plastic rod has at least one bend therein.

5. The receiver structure of claim 4 wherein said infrared conducting member is rotatable about its axis.

6. The receiver structure of claim 2 wherein said fixed end has a radiused curve and said free end is a square end which lies in a plane perpendicular to the axis of said rod.

7. The receiver structure of claim 1 wherein said infrared conducting member is rotatable about its axis.

8. The receiver structure of claim 7, wherein said fixed end has a radiused curve and said free end is a square end in a plane perpendicular to the axis of said rod.

9. The receiver structure of claim 7 which further includes support means for supporting said infrared conducting member; said support means including a flange and snaps which are integral with an end of said infrared conducting member wherein said flange and snaps are axially spaced from one another by about the thickness of a wall therebetween; said snaps being forced through an opening in said wall with said flange being trapped against a surface of said wall which is opposite to a surface engaged by said snaps.

10. The receiver structure of claim 1 wherein said infrared conducting member is a flexible end optical light fiber adapted for conducting visible light and having a length of less than about 24 inches.

11. The receiver structure of claim 10 wherein said flexible end light fiber optics comprises a gel core surrounded by a light reflecting layer and by an outermost ultraviolet-opaque layer.

12. The receiver structure of claim 10 which further includes a ceiling title support structure for supporting said free end of said infrared conducting member; said support structure comprising a bushing having an elongated tubular sleeve having a flange at one end thereof and a trim member which is slidably received in the free end of said tubular sleeve; said tubular sleeve extending through a ceiling title and having its said flange bearing on one surface of said ceiling tile and said trim member bearing on the opposite surface of said ceiling tile; said free end of said conducting member extending through the centers of said flange, said tubular sleeve and said trim member, thereby to be exposed to external radiation at the surface of said ceiling tile which receives said trim member.

13. The receiver structure of claim 12 wherein the end of said tubular sleeve opposite to said flange has a serrated, saw-tooth periphery adapted for cutting a circular opening through a ceiling tile which is to receive said cylindrical sleeve.

14. A structure for forming an opening through a thin, flat, rigid, sawable body; said structure comprising a bushing having an elongated tubular sleeve having a flange at one end thereof and a free end and a trim member which is slidably received in the free end of said tubular sleeve; said tubular sleeve extending through said body and having its said flange bearing on one surface of said body and said grim member bearing on the opposite surface of said body with said tubular sleeve extending through said body; the free end of said tubular sleeve having a serrated, saw-tooth periphery adapted for cutting a circular opening through said body; said serrated periphery being covered by said trim member.

15. The structure of claim 14 wherein said body is a ceiling tile.

16. A radiation receiver for receiving and processing an infrared signal; said radiation receiver comprising:

an infrared responsive circuit component;

a control circuit coupled to said infrared responsive component for producing an output related to signal information contained in the infrared signal received by said radiation receiver;

a housing;

an infrared conducting member extending through said housing and supported by said housing and having a fixed end disposed adjacent said infrared responsive circuit component and a free end disposed exteriorly of said housing for the reception of the infrared signal;

wherein said infrared conducting member is covered with an infrared blocking cover along its length except at said free end.

17. The radiation receiver according to claim 16, wherein said infrared blocking cover is an opaque plastic tube.

18. A radiation receiver for receiving and processing an infrared signal; said radiation receiver comprising:

an infrared responsive circuit component;

a control circuit coupled to said infrared responsive component for producing an output related to signal information contained in the infrared signal received by said radiation receiver;

a housing;

an infrared conducting member extending through said housing and supported by said housing and having a fixed end disposed adjacent said infrared responsive circuit component and a free end disposed exteriorly of said housing for the reception of the infrared signal;

wherein said infrared conducting member is covered with an infrared blocking cover along its length except at said free end;

wherein said infrared conducting member is covered with a radiation focusing structure for focusing infrared signals onto said infrared conducting member.

19. The radiation receiver according to claim 18, wherein said radiation focusing structure comprises an inverted cone for focusing incoming infrared signals onto the free end of said infrared conducting member and an infrared blocking sheath which covers said infrared conducting member except at said free end.

20. The radiation receiver according to claim 19, wherein the inverted cone is parabolic in shape.

* * * * *

UNITED STATES PATENT AND TRADEMARK OFFICE

CERTIFICATE OF CORRECTION

PATENT NO. : 6,310,440 B1
DATED : October 30, 2001
INVENTOR(S) : Lansing et al.

It is certified that error appears in the above-identified patent and that said Letters Patent is hereby corrected as shown below:

Column 17,
Lines 56 and 60, “title” should read -- tile --;
Line 12, “grim” should read -- trim --.

Signed and Sealed this

Sixth Day of May, 2003

JAMES E. ROGAN
*Director of the United States Patent and Trademark Office*